United States Patent [19]

Torgny

[11] Patent Number: 4,679,849

[45] Date of Patent: Jul. 14, 1987

[54] METHOD AND AN INVALID CHAIR FOR CONVEYING A PERSON HAVING LIMITED ABILITY TO MOVE WITHOUT HEAVY LIFTING FROM A SITTING TO A LYING POSITION

[75] Inventor: Jan Torgny, Örebro, Sweden

[73] Assignee: JATAB, Jan Torgny AB, Sweden

[21] Appl. No.: 834,276

[22] PCT Filed: Apr. 18, 1985

[86] PCT No.: PCT/SE85/00180

§ 371 Date: Dec. 10, 1985

§ 102(e) Date: Dec. 10, 1985

[87] PCT Pub. No.: WO85/04799

PCT Pub. Date: Nov. 7, 1985

[30] Foreign Application Priority Data

Apr. 19, 1984 [SE] Sweden ..... 8402222

[51] Int. Cl.[4] ..... A61G 5/00

[52] U.S. Cl. ..... 297/330; 5/67; 280/242 WC

[58] Field of Search ..... 280/242 WC; 297/330, 297/316, 347, 340, DIG. 4; 5/66, 67

[56] References Cited

U.S. PATENT DOCUMENTS 2,136,852 11/1938 Knauth ..... 297/316
3,379,450 4/1968 Jones ..... 297/330 UX
4,255,823 3/1981 Boyer et al. ..... 280/47.16 X
4,393,529 7/1983 Britz ..... 297/440
4,474,385 10/1984 Costello et al. ..... 280/242 WC

*Primary Examiner*—John A. Pekar
*Attorney, Agent, or Firm*—Sughrue, Mion, Zinn, Macpeak, and Seas

[57] ABSTRACT

In a method of moving a person (30) of limited mobility there is used a wheelchair (1) having a back part (2) and a leg support or foot-support part (4), these parts being pivotally connected to an intermediate seat part (3) and being pivotable between a sitting position, in which the parts form an angle with one another, and a horizontal position in which the aforementioned parts are substantially in register with one another. These parts of the wheelchair can also be swung about a further pivot point (6) located in the region of the center of gravity of the person (30) occupying the wheelchair. The seat part (3) and back part (2) of the wheelchair are swung about the further pivot point (6), with their mutual relative positions unchanged, until the major part of the pivotal movement of the back part towards its horizontal position has been completed. The seat part (3) and the back part (2) are then rotated in mutually opposite directions to a position in which they lie in register with one another in a horizontal plane. The pivotal movements and variations in the height of the wheelchair can be effected with the aid of electrically operated screw-drive means ($S_1$, $S_2$ and $S_3$).

8 Claims, 6 Drawing Figures

METHOD AND AN INVALID CHAIR FOR CONVEYING A PERSON HAVING LIMITED ABILITY TO MOVE WITHOUT HEAVY LIFTING FROM A SITTING TO A LYING POSITION

FIELD OF THE INVENTION

Patients of limited mobility in care need assistance in moving between different facilities, such as beds, chairs, toilets, baths etc. Hitherto such patients have been transferred from facility to facility with the aid of different devices, or have simply been carried by nursing or attendant personnel. Present day devices designed for this purpose, however, are encumbered with certain disadvantages, which greatly restrict their use. For example, it takes longer to move a patient with the aid of auxiliary lifting devices, than when lifting and carrying the patient manually. In addition, these auxiliary lifting devices are cumbersome, and tend to make the patient and the nursing personnel unsafe and unsure.

BACKGROUND ART

The method most often applied today for assisting a patient with weak legs to move from a wheelchair to a toilet without needing to use excessive body strength is one in which the patient is pushed to his/her bed and lifted thereonto with the aid of a lifting device, possibly mounted on the ceiling above the bed. The patient then takes a lying position and his/her clothes are adjusted accordingly, whereafter the patient is lifted, with the aid of the lifting device, onto a toilet invalid chair and wheeled into the toilet room. The patient is returned to his/her bed in a similar manner, where necessary washing and drying of the patient is effected.

No. SE-B-7608298-1 describes a bed of complicated construction, which is intended to enable a patient to be moved from a lying position to a sitting position. This bed replaces the funtion of a ceiling-mounted lifting device.

Described in U.S. Pat. No. 3,215,469 (Wamsley) is an invalid chair which incorporates a displaceable plate which, when moved away, enables toilet functions to be performed while seated in the chair. The chair seat is fixed horizontally and can not be adjusted to different attitudes; to render sitting more comfortable. It is difficult to understand how the patient can be washed and dried, subsequent to using the toilet basin provided.

No. EP-A-0068668 (Williams) describes a wheelchair equipped with a collapsible back rest, in which when the back rest is lowered, the chair seat is raised to a higher level. The centre of gravity of the patient, however, is thereby moved from the back rest down towards the seat, and when the patient is subjected to further upward lifting movement, there is a risk that she/he will slide out of the chair. The leg supports do not accompany this movement.

U.S. Pat. No. 4,255,823 (Boyer et al) describes a separate movable transporter which is constructed to handle invalids and which includes a wheeled frame supporting a chair structure having a back part, a seat part and a leg part, which can be swung about intermediate hinge means between a patient sitting and a patient lying (stretcher) position. The arrangement is complicated and the transporter does not constitute a wheelchair or invalid chair in the true meaning of the term.

U.S. Pat. No. 4,393,529 (Britz) describes a separate wheeled chair frame which is adapted to receive a horizontal body support comprising a plurality of hinged components. Personnel using this arrangement are also required to perform relatively heavily lifting work, inter alia when the seat it lifted over to the chair structure.

OBJECTS OF THE INVENTION

An object with one aspect of the present invention is to provide a method of the aforesaid kind by means of which a person can be moved from a sitting position in a wheelchair to a bed, or vice versa, without needing to apply strenuous lifting forces. The method can be applied, for example, when moving the person to toilet facilities, and shall afford a satisfactory and comfortable working attitude with respect to nursing personnel.

An object with a further aspect of the invention is to provide a wheelchair so constructed that it will greatly facilitate the handling of chair-bound patients, between a sitting and a lying position, and which is preferably so designed that the patient is able to control the movement of the chair components himself/herself, through drive assemblies mounted on the chair.

SUMMARY OF THE INVENTION

In accordance with the invention there is provided a method for moving a person of limited mobility from a sitting to a lying position without needing to use a heavy lifting force, there being used a wheelchair comprising a frame-carried back rest and a leg rest which are connected to an intermediate seat structure through horizontal hinge means and which can be swung between a sitting position, in which the back rest and the seat structure form an angle with one another, and a horizontal stretcher position, in which said back rest and seat structure lie approximately in the same horizontal plane, the method being mainly characterized in that the seat structure and back rest are swung in a substantially unchanged mutual position about a further hinge means until the major part of back-rest movement from an upright to a horizontal position has been completed, whereafter the seat structure and the back rest are brought into register with one another along a horizontal line, by executing swinging movements in the opposite direction.

The use of a wheelchair whose back rest and seat structure can be swung about the said further hinge point greatly facilitates the work of attendant personnel, and also enables the use of lifting devices and like means to be dispensed with. Since the back rest and seat structure are initially swung in the aforesaid manner while maintaining their relative positions unchanged, the weight of the patient is transferred to the back rest, therewith enabling swinging movement in the opposite direction to be effected with the seat structure relieved of most of the patient's weight.

In practice, the seat structure and the back rest are preferably swung initially about a hinge point located close to the centre of gravity of the person occupying the wheelchair.

In this way considerable weight is relieved both during the initial swinging movement and during said counterdirectional swinging movements.

One particular advantage afforded by the invention is that a person seated in the chair can readily be provided with the possibility of visiting the toilet, by maneuvering the wheelchair to a position in which the normal chair seat can be readily replaced with a toilet seat, without requiring the patient to vacate the chair or to move partially away therefrom. Once the toilet seat is in place, the chair is swung back to an upright sitting position and moved over the basin of a standard toilet.

In practice the rearward leg support of the wheelchair is swung down into engagement with the floor or like support surface, before commencing to swing the chair components about the further hinge point.

This ensures that the various pivotal movements of the chair components can be effected safely and reliably, without the chair tipping, even when the chair chassis has a limited length.

The invention also relates to a wheelchair with which the method can be carried out and which has the characteristic features set forth in claim 4.

The invention will now be described in more detail with reference to a number of embodiments thereof illustrated in the accompanying schematic drawings.

DESCRIPTION OF A PREFERRED EMBODIMENT

Figure 1:
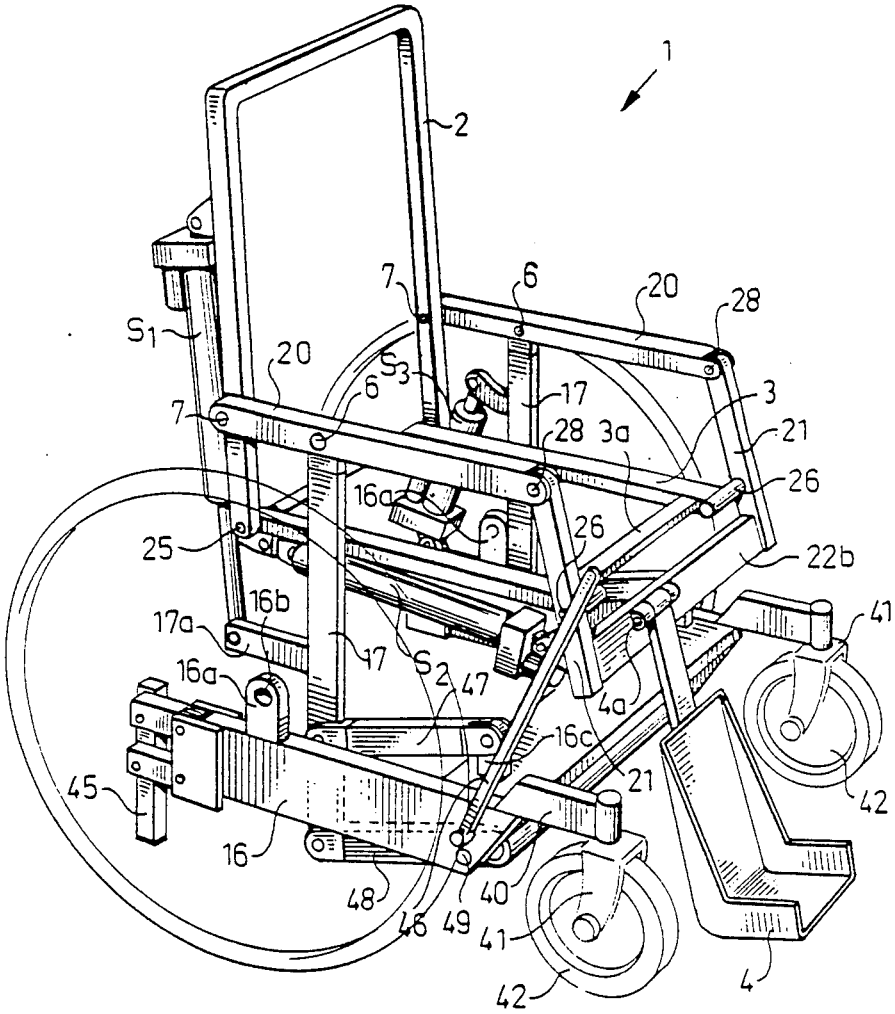
FIG. 1 is a perspective view of the more essential components of a wheelchair according to the invention.

In FIG. 1 there is shown a wheelchair 1 comprising a frame assembly which includes a horizontal lower U-shaped frame part 16 and two vertical frame parts 17. The lower horizontal frame part 16 has mounted thereon two mutually opposing upstanding legs **16*a* each having an opening 16*b* for accommodating a respective journal shaft (not shown) on which the large wheel 18** of the chair is mounted.

Located on the front of the wheelchair 1 are two forwardly projecting holder arms 40 which support swivel brackets 41 in which the forward guide wheels 42 of the chair are journalled.

The frame assembly 16, 17 carries a back rest 2 which is substantially of inverse U-shape and which is connected to a seat structure 3 through a hinge means 25. In turn, the seat structure 3 is connected to a leg or foot rest 4 through a hinge means 26.

Arm rests 20 are connected at one end to the back rest 2 through hinge means 7 and at the other end to forward struts 21 through hinge means 28. The lower ends of the forward struts 21 carry therebetween a transverse strut **22*b*, which pivotally supports the foot rest 4. The forward struts 21 are also throughpassed by the hinge means 26, which are connected to the seat structure 3 in the region of a forward transverse strut 3*a*** associated therewith.

The wheelchair components are also mounted for pivotal movement about a further hinge point 6 located between the vertical frame parts 17 and the arm rests 20.

The leg or foot rest 4 is hinged to the transverse strut **22*b* by means of a journal shaft 4*a*** which extends parallel to said strut.

The journal or hinge means 6 are located in the region of the centre of gravity of a person sitting in the wheelchair.

The pivotal movements of the various wheelchair components are effected with the aid of three screw-drive means $S_1$, $S_2$, and $S_3$ powered by means of an electric motor. The patient or a person in attendance is able to initiate the various pivotal movements by manipulating suitably located operating means.

The frame part 16 has arranged on its rear end a pivotable supporting leg 45 which can be moved between an active and an inactive position with the aid of an operating lever 46 and a link mechanism 47, 48.

Figure 2:
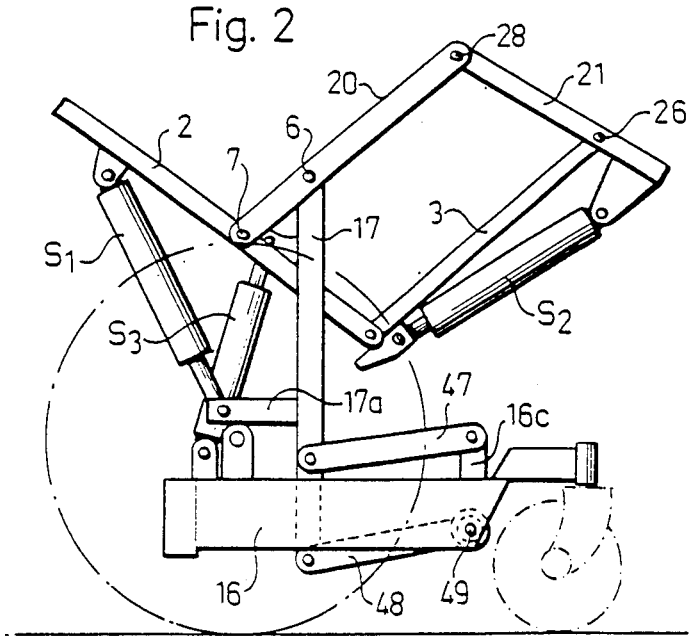
FIGS. 2–4 illustrate the sequence of movements taking place when swinging the back rest and the seat structure of the chair from the upright seating position of FIG. 1 to a horizontal stretcher-like position illustrated in FIG. 4.
Figure 3:
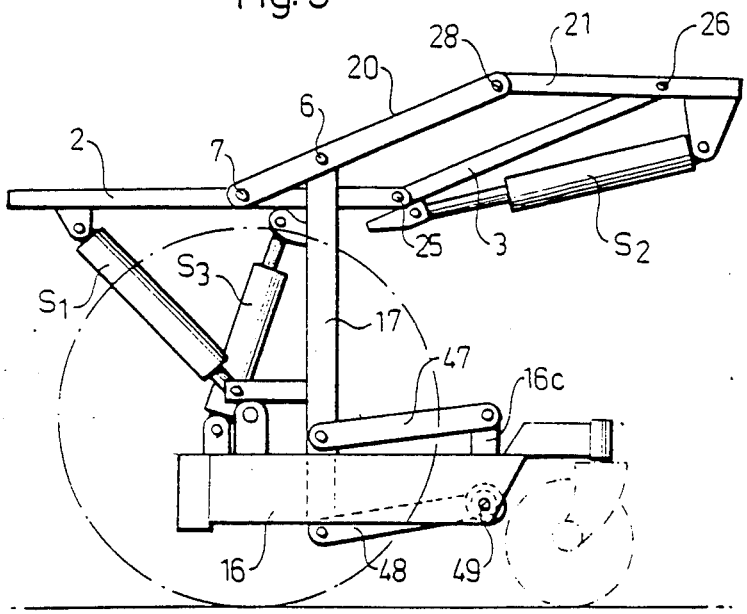
Figure 4:
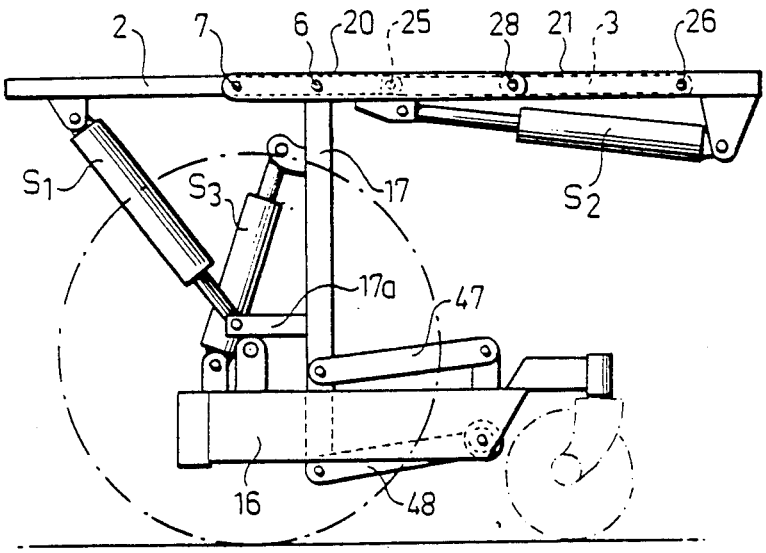

FIGS. 2–4 illustrate the course of movement when swinging the wheelchair components from the upright seating position shown in FIG. 1 to the horizontal lying position shown in FIG. 4. It will be noticed that the views of FIGS. 2–4 are schematic illustrations. For example, the views do not include the foot rest 4, nor yet the rearward pivotal support leg 45 of the chair. It will be understood that the support leg 45 is moved to its active supporting position with the aid of the lever 46.

FIGS. 2–4 illustrate generally how the back rest 2 and the seat structure 3 are first swung rearwardly in an unchanged relative position around the journal means 6. This pivotal movement continues until the major part of the pivotal movement of the back rest to a horizontal position has been completed. The weight of the person occupying the wheelchair is then substantially taken up by the back rest, thus substantially relieving the weight on the seat structure 3.

Pivotal movement is then continued with the aid of the various screw-drive means $S_1$, $S_2$ and $S_3$ about the respective journal means, from the position illustrated in FIG. 3 to the final horizontal stretcher-like position illustrated in FIG. 4. In this case the back rest 2 and the seat structure 3 are swung in mutually opposite directions.

As beforementioned, an important object of the invention is to provide a method whereby a person seated in the wheelchair can be afforted the possibility of visiting the toilet, by maneuvering the wheelchair to a position in which the normal chair seat can be readily substituted with a toilet seat, without requiring to vacate the chair or partially leave the same.

A preferred embodiment herefor will not be described in more detail.

Figure 5:
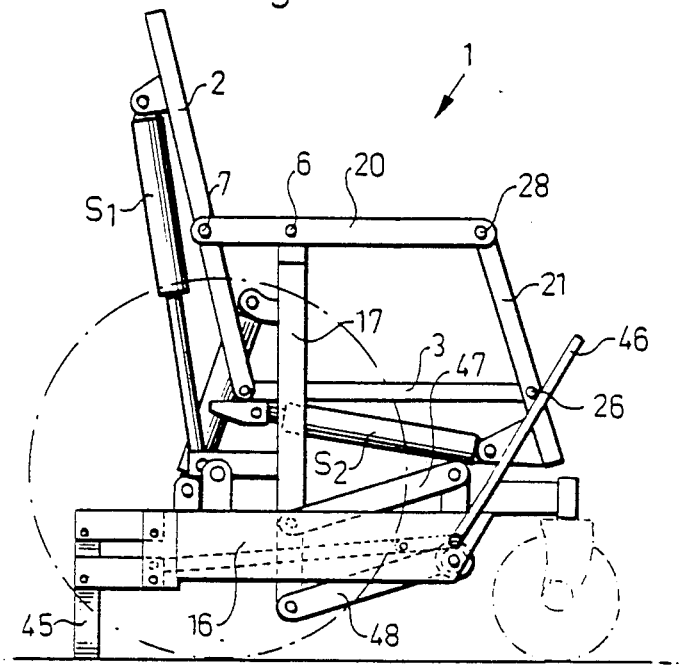
FIG. 5 is a side view illustrating the engagement of a supporting leg with the floor or like support surface.

With the wheelchair in its upright seating mode, as illustrated in FIGS. 1 and 5, the seat structure 3 and the chair parts pivotally connected thereto is swung rearwardly with the relative positions of the back rest and seat structure unchanged, this rearward movement being continued—as before mentioned—until completing the major part of the backward swing of the back rest 2 towards a horizontal position, i.e. such that most of the weight of the person occupying the chair is on the back rest.

Rearward swinging of the back rest 2 towards the horizontal is then continued, by straightening out the hinge means 7 until the back rest 2, the seat structure and optionally also the foot support all lie in a mutually common horizontal plane. The hinge means 7 is straightened out, by pivoting the seat structure in a direction opposite to the direction of a continued movement of the back rest.

The clothes of the person concerned can then be adjusted for his/her toilet requirements. The regular seat (not shown) of the wheelchair can be removed and replaced with a toilet seat (not shown). The chair can then be raised to its upright position, and pushed over a conventional toilet basin.

The chair can thereafter be adjusted to its horizontal, lying mode and the clothes of the occupant re-adjusted and the regular chair seat replaced. The chair is then again returned to its upright sitting mode.

During movement from a sitting position to a lying position in the aforedescribed manner, the occupant of the chair is located in a position relative to the back rest in which the two aforesaid seats can be interchanged without difficulty. The location of the hinge means 6 in the region of the centre of gravity of the chair occupant, enables all necessary movements to be effected with the aid of manual forces. These movements, however, may also be effected with the aid of motorized forces, for example with the aid of screw motors of the kind illustrated in the drawings.

In the illustrated embodiment, those parts of the chair which support the occupant comprise two four-hinge mechanisms, including components 2, 3, 20 and 21, which are joined by the back rest and seat structure and the transverse struts 3*a* and 22*b*. The main frame (not shown) of the back rest is padded, and said back-rest frame, seat structure and arm rests are connected to their respective parts of the four-hinge mechanism in a manner such as to leave a small clearance. This enables the chair upholstery to be varied, by using upholstery material (not shown) adapted to respective parts of the chair and held together along the edge of an elastic tape (not shown) provided therefor.

Movement of the chair between its two positions can also be effected in an alternative manner, using the back rest as a lever arm to gear down the force required and replacing lifting forces with downward pressing forces, which is ergonomically favourable.

In this case the chair back is raised to a vertical position and the hinge means 7 locked. The hinge 6 is then released and the upper part of the back rest 2 moved rearwardly. The chair occupant is moved so far backwards that the major part of his/her weight will lie on the back rest. The hinge means 6 is then locked and the hinge means 7 released. Subsequent hereto the upper part of the back rest is pressed down to lie close to its horizontal position, whereafter the hinge means 7 is locked and the hinge means 6 released. The upper part of the back rest is then moved upwardly so as to be suitably inclined relatively close to the horizontal plane. The hinge means 6 is then locked and the hinge means 7 released, whereafter the upper part of the back rest is pressed down. The centre of gravity of the chair occupant is lifted slightly in this way, and said movements are continued until the desired position is reached.

Figure 6:
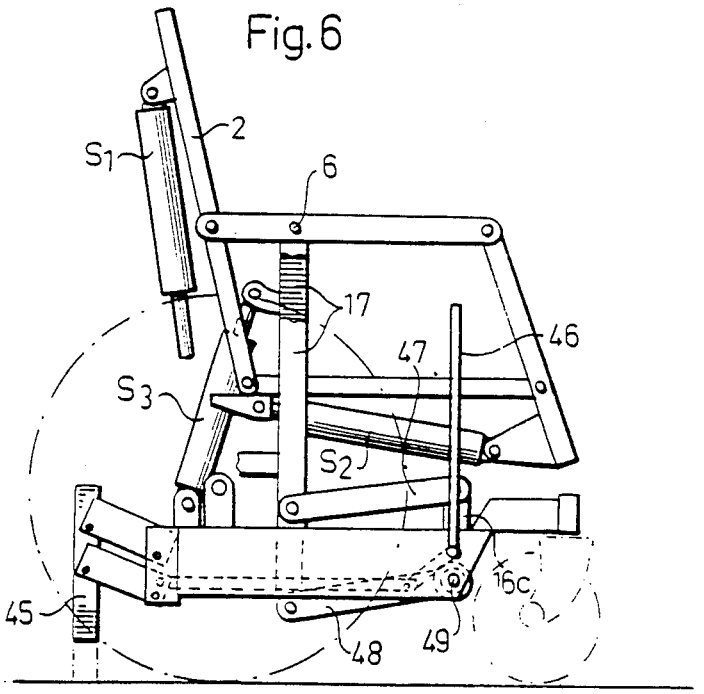
FIG. 6 is a view similar to FIG. 5 but with the supporting leg lifted away from the floor, this Figure also showing means for adjusting the vertical height of the wheelchair.

FIG. 6 illustrates the vertical adjustment of the chair seat structure, which in the seating position is effected by activating the screw-drive means $S_2$, with the two remaining screw-drive means $S_1$ and $S_3$ remaining passive.

In order to facilitate the use of a chair constructed in accordance with the invention in a home environment, the chair is arranged to be lowered to a position in which the foot rest bears against the floor. To enable the chair to be lowered still further, the foot rest is pivotally connected to the supporting part 22*b*.

INDUSTRIAL APPLICATION

The principle of the invention can also be applied with motorized wheelchairs, where the chair drive motor (not shown) can be used to provide the power required to swing the chair back towards a horizontal position and to then swing the chair components out to obtain a horizontal lying surface.

The chair occupant, who is assumed to be disabled, can then readily roll onto a bed, i.e. the aforedescribed operations can be carried out without requiring the assistance nursing personnel.

I claim:

1. A method for moving a person of limited mobility from a sitting to a recumbent position with a wheelchair having components in the form of a frame-carried back part and a leg or foot rest which are joined to an intermediate seat structure through horizontal journal means and which can be swung between an upright sitting position in which said chair components form angles relative to one another, and a horizontal recumbent stretcher-like position in which said chair components lie approximately in the same horizontal plane, characterized by the steps of:

swinging the seat structure and back part of the wheelchair about a further journal means positioned close to the center of gravity of the person sitting in the wheelchair with mutual relative positions of said foot rest and back part substantially unchanged, until completing the major part of the pivotal movement of the back part from its upright position towards its horizontal position, by a first drive means on the frame structure engaging the back part, bringing the seat structure and the back part to a position in which they lie horizontally in register with one another by rotating the seat structure and the back part in mutually opposite directions by means of a second drive means connected to a rear bottom part of the chair and engaging a member connected to the foot rest.

2. A method according to claim 1, characterized by moving a rearwardly located supporting leg mounted on the wheelchair into engagement with the floor or like supporting surface, prior to rotating the seat structure and back rest about said further journal means.

3. A wheelchair for moving a person of limited mobility from an upright sitting position to a recumbent position, said wheelchair (1) comprising:

a wheeled frame structure comprising at least a fixed horizontal frame structure (16) and a vertical frame structure (17, 17*a*, 47, 48);

a seat structure (3) having a front portion, a rear portion and an arm rest structure (20, 21);

a back rest (2);

a leg rest (4);

first and second journals (25, 26) respectively arranged in the regions of the front portion and rear portion of the seat structure, said first journal (25) connecting said back rest to said rear portion of said seat structure, and said second journal (26) connecting said leg rest to said front portion of said seat structure;

a third journal (7) connecting said arm rest structure (20) to said back rest;

a fourth journal (6) connecting said arm rest structure of the seat structure (3) and a member (17) of the vertical frame structure, said fourth journal being located close the center of gravity of a person sitting in the wheelchair and about which the back rest and seat structure (3) can be swung;

a first drive means connecting said back rest (2) to said vertical frame structure (17*a*), said first drive means enabling the back rest and said seat structure to be swung about the fourth journal, while retaining the mutual relative positions of the back rest and seat structure unchanged, to a first position in which the major part of the pivotal movement of the back rest (2) towards its horizontal position has been completed;

a second drive means (S2) connected between said rear position of said seat structure and said leg rest, said second drive means operable when said back rest and seat structure are in said first chair position for movement of the seat structure (3) and back rest (2) in mutually opposite directions to a second position in which the back rest and the seat structure lie substantially in register with each other in a horizontal plane.

4. A wheelchair according to claim 3, characterized in that said fourth journal (6) is located between the ends of the arm rest (20) and closer its rear end connected with the back rest (2) than its front end.

5. A wheelchair according to claim 4, characterized in that a frame part (16) of said frame structure (16, 17) carries a pivotable support leg (45) for engagement with the floor or like supporting surface prior to commencing the pivotal movement of the seat structure and back rest.

6. A wheelchair according to claim 5, characterized by a forwardly located operating lever for manipulating the support leg (45).

7. A wheelchair according to, any one of claims 3, 4, 5 or 6 characterized in that a drive means (S3) for adjusting the vertical position of the seat structure (3) is arranged between the horizontal and vertical parts of the frame structure.

8. A wheelchair according to claim 7, characterized in that the foot support is pivotally connected to the part (22*b*) supporting the same.

* * * * *